United States Patent [19]

Fougea

[11] 4,060,358

[45] Nov. 29, 1977

[54] CLIMBING SCAFFOLDING ASSEMBLIES WITH ASSOCIATED SHUTTERING

[75] Inventor: Bernard Fougea, Neuilly-sur-Seine, France

[73] Assignee: Coignet S.A., France

[21] Appl. No.: 691,212

[22] Filed: May 28, 1976

[30] Foreign Application Priority Data

June 5, 1975 France ..... 75.17557

[51] Int. Cl.[2] ..... E04G 11/04

[52] U.S. Cl. ..... 425/65; 182/82; 182/128; 182/150; 249/20

[58] Field of Search ..... 425/63, 65; 249/20–22; 264/33, 34; 182/82, 128, 150

[56] References Cited

U.S. PATENT DOCUMENTS

| | | | |
|---|---|---|---|
| 3,222,750 | 12/1965 | Kimball | 425/65 |
| 3,472,477 | 10/1969 | Juhl | 249/20 |
| 3,521,336 | 7/1970 | Rohlf | 249/20 |
| 3,908,793 | 9/1975 | Vaughn et al. | 182/82 |

FOREIGN PATENT DOCUMENTS

| | | | |
|---|---|---|---|
| 1,928,224 | 12/1970 | Germany | 182/150 |
| 1,385,571 | 2/1975 | United Kingdom | 249/22 |

*Primary Examiner*—Francis S. Husar
*Assistant Examiner*—John McQuade
*Attorney, Agent, or Firm*—Diller, Brown, Ramik & Wight

[57] ABSTRACT

A scaffolding assembly is made up of independent units each of which is fitted with inside and outside shuttering panels. The assembly is particularly suitable for in situ casting of walls in reinforced concrete, in successive layers which may vary in their inclination to the vertical. Each unit includes a support frame which is attached to one surface of the wall in progress and is fitted with one shuttering panel and a first assembly of catwalks. At its upper end it has a cantilever which overhangs the top of the wall, from which is suspended a movable frame substantially parallel to the support frame. The position of the movable frame on the cantilever is adjustable, to vary its distance from the support frame. The movable frame is fitted with the other shuttering panel and with a second catwalk assembly. A lifting system on the support frame co-operates with attachments on the wall to raise the unit. It includes at least two cams on each upright of a support frame which progressively engage the attachments to clamp the support frame in position. This system also includes slidable bearing arms which positively engage the attachments and which are retracted during raising of the unit. The horizontal position of all the catwalks of each catwalk assembly are simultaneously set by a respective levelling system. At least one side of each catwalk assembly is extensible to provide catwalks continuous from one scaffolding unit of the assembly to the next.

12 Claims, 8 Drawing Figures

CLIMBING SCAFFOLDING ASSEMBLIES WITH ASSOCIATED SHUTTERING

The object of the present invention is a climbing scaffolding assembly with associated shuttering, particularly suitable for in situ casting of reinforced concrete walls in successive layers, being supported for the casting of each layer on the lower part of the wall already cast in the same way.

Such apparatus requires no support on the ground and so can be used to build walls of unlimited height. In particular it enables walls to be built which have varying thickness, any shape in plan view (especially circular), varying inclination to the vertical, so as to follow the generatrix of any volume (a hyperboloid of revolution, for example).

Until now, there have been known climbing scaffolding assemblies which are completely independent of the shuttering or attached to the shuttering; in either case, each side is independent of the opposing one. When the scaffolding is supported by the shuttering, it is usual for the shuttering to have two sets of shuttering panels which are alternately lifted for the casting of successive layers. In all circumstances, such scaffolding always requires a minimum sequence of distinct operations on each side for the casting of a layer, namely: disengagement and raising of a shuttering layer, followed by corresponding raising of the scaffolding, i.e. two operations for each shuttered face.

There are also known climbing scaffolding assemblies which are rigidly guided by the shuttering panels and which require three distinct operations to raise them, by shifting a common arrangement to successively lift the shuttering panels and the scaffolding assembly.

Also, in most forms of apparatus known hitherto which allow for building at a variable angle to the vertical, the shuttering panels require manual labour, which restricts their weight and therefore their surface area. It is then necessary to increase the number of vertical joints between shuttering panels in the same layer, or to limit the height of each layer. This in turn results in an increase in the number of horizontal casting steps and an increase in the construction time of the project.

The present invention is intended to remedy the disadvantages mentioned above and also to provide safe working conditions involving a minimum of strenuous physical labour.

To this end the invention consists in a scaffolding unit fitted with inside and outside shuttering panels, particularly but not exclusively for in situ casting of reinforced concrete walls in successive layers which may vary in their inclination to the vertical, comprising a support frame which in use is attached to one surface of the wall in progress and is fitted with an arrangement for supporting and adjusting a first shuttering panel and with a first assembly of working catwalks, and which has at its upper end a cantilever which in use overhangs the top of the wall in progress; a movable frame substantially parallel to the support frame, supported by the cantilever and fitted with a second shuttering panel and a second assembly of working catwalks, the movable frame being adjustable in position on the cantilever to vary its distance from the support frame; and a system on the support frame which in use co-operates with attachment elements on said surface of the wall in progress to raise the support frame, the cantilever and the movable frame, and thereby to raise both shuttering panels and both catwalk assemblies.

The support frame advantageously includes at least two uprights shaped to provide guide rails and which are interconnected by cross-pieces.

A first advantage of the invention consists in the possibility of lifting the scaffolding and shuttering panels on both sides of the wall in a single operation, by means of a displacement system integral with the scaffolding assembly.

The association of the shuttering with the scaffolding eliminates the size limitations mentioned above, as manual labour is done away with; the number of vertical joints between adjacent shuttering assemblies can thus be optimised and the quality of the wall improved.

Moreover, the design of the framework by combination of a structure with a cross-section in the shape of an inverted 'L' and a movable frame enables the shuttering panels to be easily suspended and manoeuvred, in spite of their size and weight, and to be adequately drawn back from the walls.

The system on the support frame for raising the support frame and the movable frame preferably includes a plurality of rollers mounted on the uprights and in use rolling on said surface of the wall in progress, and cylinders acting in traction, each of which is pivoted at its lower end to a member attached to the lower end of one of the uprights and has its upper end engaged with one of the attachments on said surface of the wall in progress.

Unlike some known apparatus using intermediate rails, apparatus in accordance with the invention makes use of the support frame to carry out this function; this arrangement assures strict location of the support frame relative to the wall so that it can serve as a reference for adjusting the associated shuttering panel after each lifting operation.

As far as efficiency is concerned, it will be noted that the use of cylinders working only in traction allows a high lift to be obtained in one operation, which reduces the time and number of casting steps.

Each of said attachment elements on said surface of the wall in progress is preferably aligned with one of the uprights of the support frame and is generally corbel-shaped, having spaced rear support areas which in use bear on the concrete wall, a forwardly extending section with a substantially horizontal upper surface which acts as a support surface, and a front plate adapted to co-operate with one face of the upright with which it is aligned to provide a vertical guide therefor, each such attachment element being adapted to be temporarily attached to the wall by means of a bar passing through it and a wedge, there being at least one such attachment element per upright per layer of the wall.

The system on the support frame for raising the frames preferably includes clamping members which in use co-operate with the attachment elements and which consist of at least two cams attached to each upright, one above the other, on the face thereof which co-operates with the attachment element front plates, which progressively engage said front plates to clamp the upright in position.

Said system preferably further comprises locking members including guide boxes attached to the uprights and containing slidable bearing arms which are movable between a forward position in which at least one of them positively contacts said support surface of an attachment element, and a rear position to which they are retracted during raising of the scaffolding unit.

The combination of the rollers and the cams assures guiding of the support frame with sufficient play to avoid jamming during lifting, especially with a changing curvature, with positive and effective clamping in the working position, all along the wall.

The lengths and profiles of the cams are preferably such that each can be simultaneously engaged at its ends with two consecutive attachment elements, the lower cam being clamped at its lower end and free at its upper end, the attachment element which is positively contacted by a slidable bearing arm of the locking means being the lower one.

This arrangement backs up the previously mentioned arrangement of cams and slidable bearing arms; in practice, at the very beginning of the operation of raising a scaffolding unit, the upper end of at least one cam is engaged with the attachment element with which it will co-operate to provide the clamping action at the end of the operation; the raising is thus unimpeded, but the play of the associated support frame is kept within acceptable limits. Moreover, taking the weight of the scaffolding unit on a slidable bearing arm adjacent each upright enables a second slidable bearing arm to be kept in reserve, arranged so as not to be in positive contact with the attachment element but so as to be able to take over virtually instantaneously should the former fail.

The unit preferably includes a system for continuously adjusting the distance between the movable and support frames, to ensure a constant distance to the facing wall surface.

The ability to vary the distance between the support and movable frames allows the associated catwalk assemblies to be maintained at all times as close as is required to the wall surfaces, whatever the thickness of the wall, while maintaining a sufficient clearance of the outside shuttering panels from the wall for preparatory operations prior to casting to be carried out in safety and with minimal fatigue.

The catwalk assemblies are preferably pivoted to the uprights of the support or movable frame and to uprights parallel thereto which are inter-connected by horizontal rails acting as guard rails, so as to form a succession of deformable parallelograms, respective cross-pieces attached to the support and movable frames carrying respective systems for simultaneously maintaining each catwalk assembly horizontal, the cross-pieces limiting the inclination of the catwalk assemblies when not held horizontal.

At least one side of the scaffolding unit preferably comprises telescopic means for extending the catwalk and guard rails, so that when the unit is used in co-operation with other like units it is possible to provide a catwalk and guard rail which is continuous from one unit to the next.

These arrangements are aimed at providing good access to all work stations, with continuous circulation for and protection of the personnel, in spite of varying distances between adjacent scaffolding units, and in great safety.

Further features and advantages of the invention will emerge from the following description of an embodiment of the scaffolding assembly in accordance with the invention, which is given by way of non-limiting example and with reference to the accompanying drawings.

The example selected concerns the use of the equipment for the construction of a cooling tower having the form of a hyperboloid of revolution with walls of varying thickness, a structure calling for the use of a great many of the possibilities offered by the invention.

Figure 1:
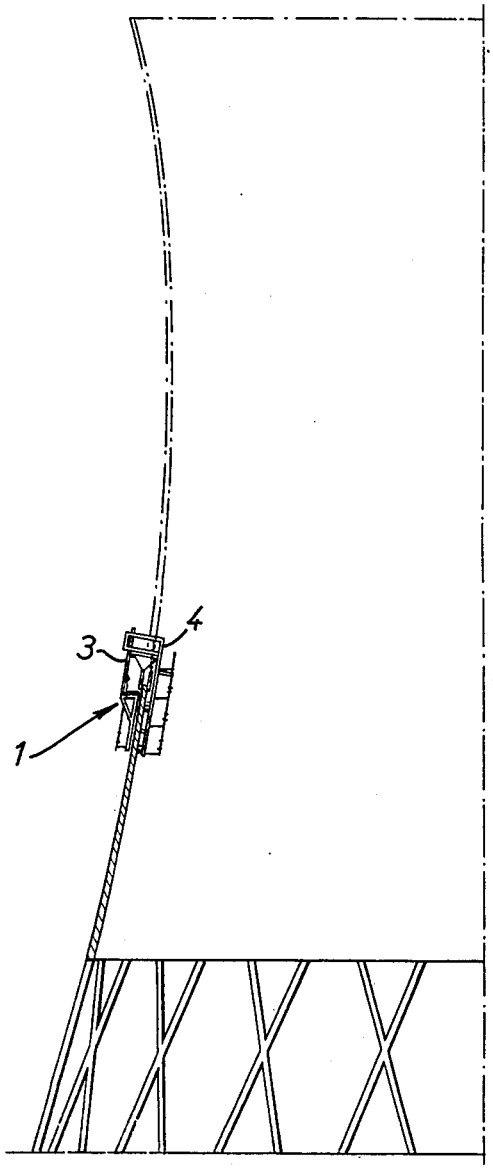
FIG. 1 is a general view in section on the line 1—1 of FIG. 2, showing a scaffolding unit in accordance with the invention in its working position on a wall under construction.
Figure 2:
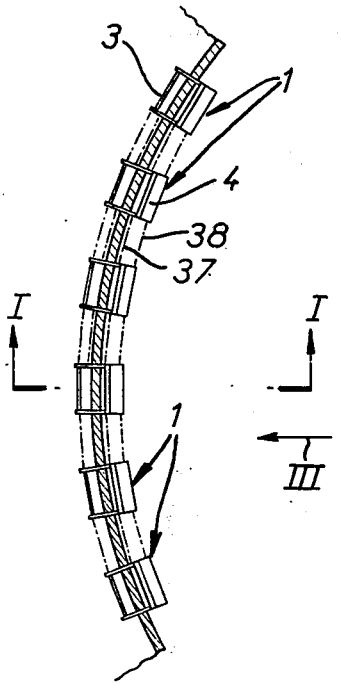
FIG. 2 is a plan view of a similar project to that shown in FIG. 1, showing a succession of scaffolding units for casting a structure of circular cross-section.
Figure 5:
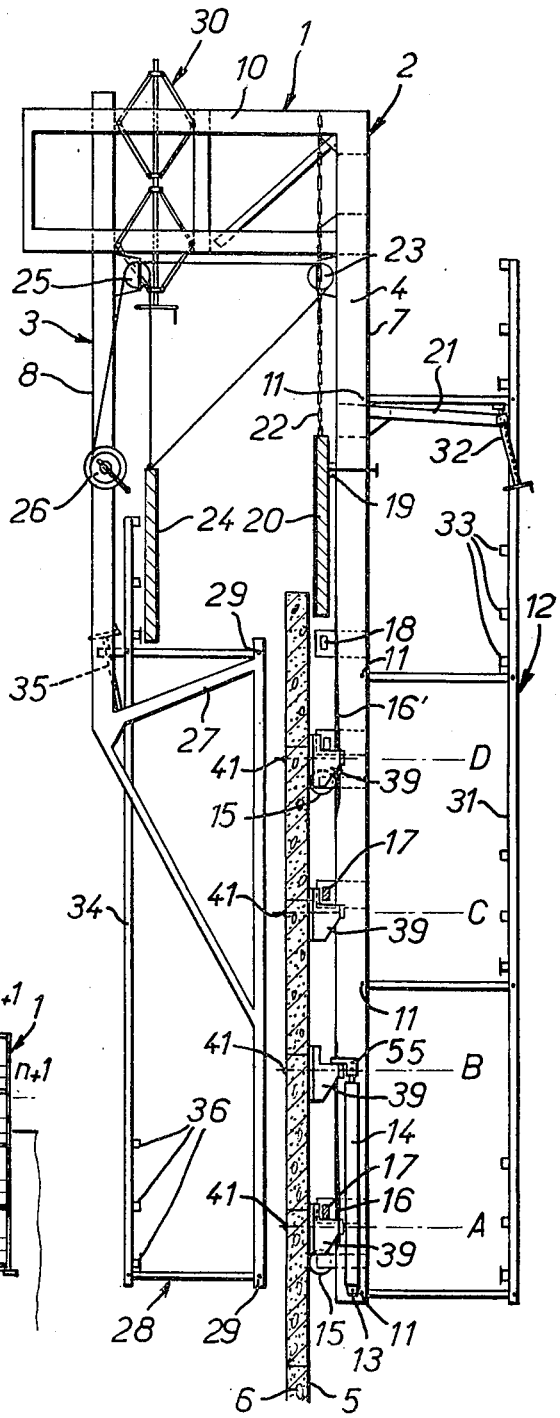
FIG. 5 is a partial sectional view of a scaffolding unit at the end of a raising operation, the shuttering panels being ready for positioning for casting.
Figure 4:
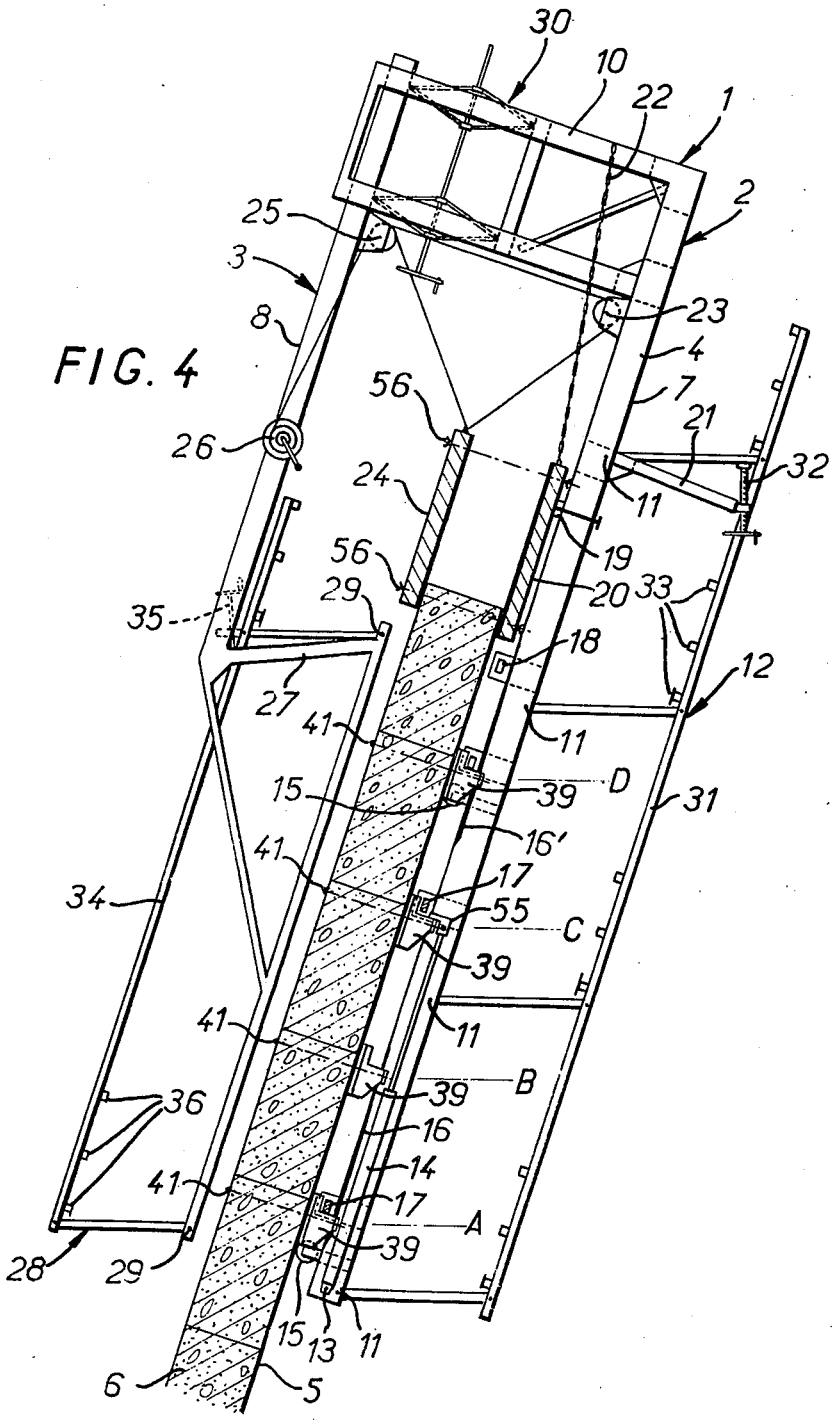
FIG. 4 is a partial sectional view of a scaffolding unit in accordance with the invention in the position for casting a layer of the lower portion of the structure of FIG. 1.
Figure 6:
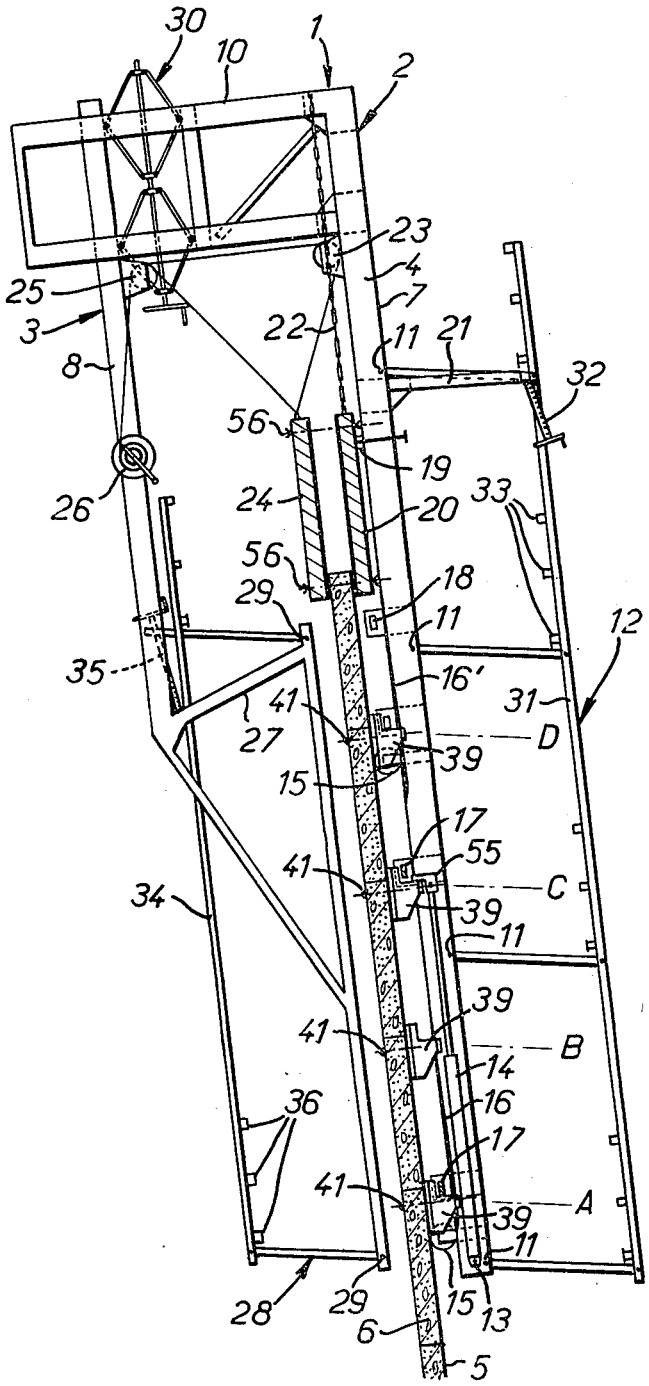
FIG. 6 is a partial sectional view of a scaffolding unit in the position for casting a layer of the upper portion of the wall of the structure fo FIG. 1.

Referring to FIGS. 4, 5 and 6, it will be noted that each scaffolding unit consists of a metal framework in the shape of an inverted 'U', indicated generally at 1. It is made up of a structure 2 having a cross-section in the shape of an inverted 'L', and a movable frame 3. The structure 2 includes a support frame 4 attached to the face 5 of the wall 6, and a cantilever 10 from which is suspended the movable frame 3. The support frame 4 and movable frame 3 respectively consist of pairs of uprights 7 and 8 connected together by cross-pieces which can be seen in FIG. 8, referenced 9. The uprights 7 of the support frame are associated with respective cantilevers which are inter-connected crosswise to form the rigid cantilever assembly referenced 10.

Seeing that the structure to be built has inside and outside faces, it is preferable to locate the support frames 4 inside the structure; without limiting the scope of the invention, the face 5 of the wall and all the associated parts of the scaffolding unit will hereinafter be referred to as the inside ones.

There now follows a description of the component parts and characteristics accessories of the various subassemblies of a scaffolding assembly in accordance with the invention; their association in use will emerge from the description of their operation to be given later.

Figure 8:
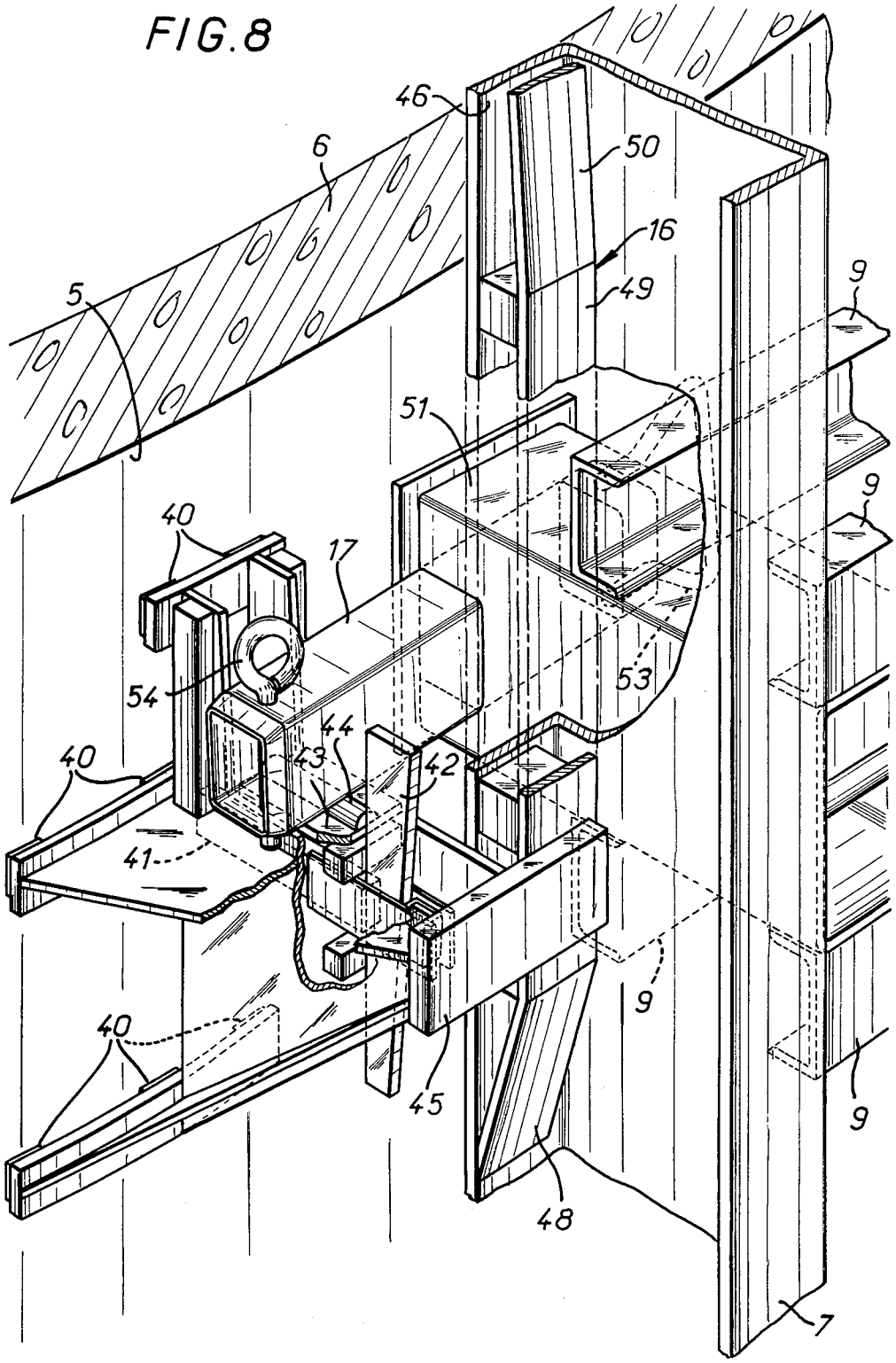
FIG. 8 is a perspective view to a larger scale showing an attachment element engaged by the cam of the associated upright.

The support frame 4 of each structure 2 comprises:

pivot pins 11 for the inside service catwalks 12;

attachments 13 which co-operate with the lower ends of hydraulic cylinders 14 with controllable non-return valves, which are for raising the scaffolding unit and of which there is one for each upright 7;

rollers 15 which support the scaffolding unit on the face 5 of the wall 6 already built, via the support frame 4;

two cams 16 and 16' on each upright 7 of the support frame 4, the function of which will be described below, with particular reference to FIG. 8;

slidable bearing arms 17 which will also be described later;

upper fixed bearing arms 18 for supporting the scaffolding unit 1 for the casting of the first layers of concrete;

one adjustable shuttering panel support 19 for each upright 7, ensuring that the inside shuttering panel bears on the uprights;

cross-pieces 21 for limiting the inclination of the inside catwalk assembly 12.

Each cantilever 10 has:

a set of attachments 22 from which is suspended the inside shuttering panel 20;

a set of pulleys 23 from which is suspended the outside shuttering panel 24.

Each movable frame 3, suspended at the free end of a cantilever 10, has:

a set of pulleys 25 from which is suspended the outside shuttering panel 24;

a set of wall-hoists 26 for moving the outside shuttering panel 24;

cross-pieces 27 for limiting the inclination of the outside service catwalk assembly 28;

pivot axes 29 for the catwalk assembly 28.

The adjustment of the horizontal position of the movable frames 3 on the cantilevers 10 is effected by a four bar linkage type of device 30 which enables the distance between the support frames 4 and movable frames 3 to be continuously adjusted, while maintaining them parallel. The adjustment is carried out from the upper level of the outside catwalk assembly 28.

The inside and outside catwalk assemblies 12 and 28 are assembled in virtually the same way.

On the inside, the catwalk levers (four in number in this case) are pivoted to a common upright 31 so that, by virtue of the free movement of the pivots 11 on the support frame uprights 7, there is formed a succession of four bar linkages, any adjustment of the inclination of one of them by means of the device 32 automatically adjusting that of the others. At each working level a set of guard rails and skirting boards 33 ensures the safety of the personnel.

On the outside, the catwalk levels, which are at least two in number, are pivoted to an upright 34, and an adjusting device 35 controls the horizontal position of the catwalk levels simultaneously, as for the inside catwalks; a set of guard rails and skirting boards 36 safeguards the personnel.

The devices 32 and 35 for adjusting the inclination of the catwalk levels of the respective assemblies 12 and 28 bear on the cross-pieces 21 and 27 mentioned above; it will be noted that the angular movement of the catwalk levels of the assemblies 12 and 28, resulting from their bilateral pivotal mounting, is limited by these cross-pieces 21 and 27, which insures against the catwalks dropping down in the event of failure of the devices 32 or 35, eliminating the risk of the personnel falling from the unit in such an event.

Figure 7:
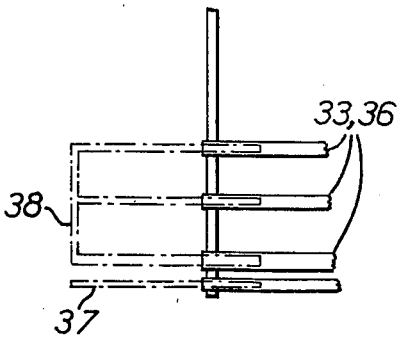
FIG. 7 is a detailed elevation showing the interconnection of two catwalk elements.

To provide a continuous floor from one unit to the next at each catwalk level, and continuous safety barriers formed by the guard rails and skirting boards 33, at least one side of each catwalk is fitted with respective devices (37 and 38 in FIG. 7) for extending the flooring and safety barrier, these devices being adjustable in accordance with the gap between adjacent scaffolding units.

Referring still to FIGS. 4, 5 and 6, and now also to FIG. 8, the structure of the attachment elements and clamping and locking members will now be described, with the manner in which they co-operate.

The attachment elements consist of corbel-like supports indicated generally by the reference 39; they are constructed in the conventional manner from metal sheet and structural sections, and only their most relevant features will be described. Each element 39 includes:

a series of support pads 40 arranged so as to enable the elements to resist any force tending to make them move on the wall;

a bar 41 passing through the concrete wall 6 and a tapered wedge 42 which wedges into the head of the bar 41 (not shown) to fix the element in the sense of the axis of the bar 41;

a support plate 43 with an axial projection 44;

a front plate 45 substantially perpendicular to the axis of the bar 41.

On the inside face 46 of each upright 7 of the support frame 4 are disposed cams 16 and 16' which each have a bottom ramp 48, a plane face 49 substantially parallel to the face 46 of the associated upright 7, and a top ramp 50. The cam 16' is longer than the cam 16, the reason for which will be explained later.

At the appropriate levels the uprights 7 are fitted with box-girders 51 in which the slidable bearing arms 17 are slidably mounted for movement along axes which are slightly inclined to the horizontal. Each slidable bearing arm 17 has a handle 53 at a rear end for manoeuvring it and a fastening pin 54 at its front end.

In the embodiment shown in FIGS. 4, 5 and 6, there are four attachment elements 39 which will be indexed A, B, C and D to facilitate the following description. Generally speaking, the lengths of the cams 16 and 16' are such that they can be simultaneously engaged with the front plates 45 of two consecutive elements 39 (A and B), their bottom ramps 48 being relatively short and their top ramps 50 being relatively long.

Guiding of the uprights 7 with respect to the wall 6 can thus take place either:

without play in the working position, by engaging the plane face 49 of the cam 16 or 16' with the front plate 45 of the facing element 39 (levels A and D in FIGS. 4, 5 and 6, and as in FIG. 8), or with a variable amount of play to facilitate movement during raising of the scaffolding unit (levels B and C).

The relative lengths of the ramps 48 and 50 provide for rapid disengagement of the cams from the attachment element front plates on raising the unit, with very gradual engagement with the next attachment element, to provide guiding without jamming.

The attachment elements 39 have two other functions in addition to the guide function just described, namely:

to take over the weight of the scaffolding unit in the working position, by means of the slidable bearing arms 17 which rest on the projections 44 of the plates 43, and to provide engagement points for the heads 55 of cylinders 14.

In the embodiment shown in FIGS. 4, 5 and 6, the fixed and movable elements co-operate as follows:

LEVEL A

Cam 16 clamps the front plate 45 of the attachment element 39;

Slidable bearing arm 17 in the forward position positively contacts the projection 44 on the plate 43.

LEVEL B

Cam 16 loosely engages the plate 45 of the attachment element 39.

LEVEL C

Slidable bearing arm 17 is in the "safety" advanced position, i.e. slightly above the projection 44 of the plate 43;

Engagement of the head 55 of the cylinder 14 (at the moment of lift).

LEVEL D

Cam 16' clamps the front plate 45 of the element 39;

Slidable bearing arm 17 is retracted.

It will no doubt be recalled that the upper fixed bearing arm 18 is only used for the casting of the first layers of concrete. When casting, the shuttering panels 20 and 24 are connected together by bracing bolts 56 which pass through holes which are subsequently used to mount the bars 41 of the attachment elements 39.

The principle of operation of a scaffolding assembly in accordance with the invention will now be outlined, for the operation of lifting the assembly between successive layers of concrete.

Generally speaking, the scaffolding units and associated shuttering are designed to allow one layer of concrete to be cast on each working day *d*.

Each day the following sequence of operations is carried out, the layer $n-1$ having been cast the previous day:

The bracing bolts 56 joining the inside 20 and outside 24 shuttering panels are unfastened;

The outside shuttering panel 24 is disengaged with the aid of the pulleys 23 and 25 and the wall-hoist 26 (see FIG. 5).

It should be noted that the design of the scaffolding unit allows the personnel to move freely back and forth between the retracted shuttering panel 24 and the unshuttered wall surface.

The inside shuttering panel 20 is disengaged by means of the adjustable supports 19.

At this stage the scaffolding unit is ready to be raised with the associated shuttering panels. To this end:

The heads 55 of the cylinders 14 are fastened to the attachment elements 39 at the level of the safety bearing arms (C);

The scaffolding unit and shuttering panels are raised by means of the cylinders 14, the advanced slidable bearing arms 17 being retracted at the appropriate moment.

It will be recalled that the cylinders 14 are fitted with controlled non-return valves. These are mounted in fixed positions on the cylinders to stop the scaffolding unit immediately should any of the flexible conduits supply working fluid to the cylinders break.

Removal of the tapered wedge 42 at the lower level (A) is followed by removal of the bar 41;

The thus freed attachment elements 39 are lifted and fitted higher up by means of the holes through which passed the bolts 56 providing the lower cross-bracing of the shuttering panels;

At the end of the lift, the slidable bearing arms 17 for positive and "safety" engagement with the attachment elements are advanced.

Note should be taken of the guiding action provided by the cams 16 and 16' in combination and in relay, which limits the free movement of the support frames 4. During the raising operation, the longer cam 16' continues to provide a guiding action, without play, for a period during which the cam 16 at level B becomes more tightly engaged; the upper end of the cam 16' engages the attachment element 39 as soon as the latter is raised from level A to the level vacated by the lower bolts 56.

The shuttering panels are then cleaned and oiled and the reinforcement members put in place, in the usual manner; the panels 20 are then put into position and adjusted on the supports 19, before the panels 24 are put into place and adjusted relative to them. The two shuttering surfaces are finally connected rigidly together by means of the cross-bracing bolts 56.

The assembly is then ready for the casting of the concrete of layer *n* for day *d*.

The same operations are repeated the following day $d+1$.

Figure 3:
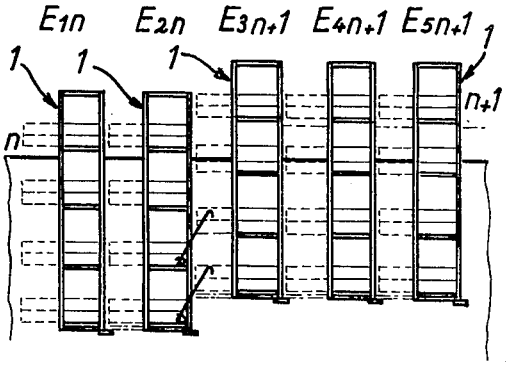
FIG. 3 is a partial elevation showing the scaffolding units of FIG. 2, with units E1*n* and E2*n* in the position for casting layer *n* and units E3*n*+1 to E5*n*+1 in the position for casting layer *n*+1.

This sequence of operations can be seen particularly clearly from FIG. 3.

It will be noted that the only elements requiring manual labour are the attachment elements, which are independent and light, and only two of which need to be moved during the raising of one scaffolding unit in accordance with the invention.

I claim:

1. A climbing scaffolding assembly for in situ casting a reinforced concrete wall in successive superposed layers of variable inclination, said assembly comprising a scaffolding unit of generally inverted U-shaped configuration including a support frame adapted to be disposed to one side of a wall in construction and to bear against the one wall side only, a cantilever member disposed at an end of said support frame for defining headspace above the top of a wall portion previously cast and a movable frame suspended from said cantilever member and generally parallel to and spaced from said support frame, means operatively associated with said movable frame for adjusting the position of said movable frame with respect to said support frame, a first shuttering panel and first set of working catwalks provided on said support frame, a second shuttering panel provided adjacent to said movable frame and a second set of working catwalks provided on said movable frame, said shuttering panels corresonding to opposed sides of a wall portion to be cast, first cooperable means securable to the said one side of a lower portion of a previously cast wall portion and second cooperable means on said support frame cooperable with said first cooperable means and associated with motor means mounted on said support frame for lifting the entire scaffolding unit including said support frame and said movable frame, said cantilever member, said first and second shuttering panels and said first and second sets of catwalks all in unison from a level corresponding to a last-poured layer of concrete to a lever corresponding to the layer of concrete to be poured next.

2. A scaffolding assembly as set forth in claim 1, wherein said support frame includes at least two uprights shaped to provide guide rails and inter-connected by cross-pieces.

3. A scaffolding assembly as set forth in claim 2, wherein said second cooperable means on said support frame for raising said support and movable frames include clamping and locking means cooperable with said first cooperable means, which first cooperable means include attachment elements having means for temporarily attaching said attachment elements to a surface of a previously cast wall portion and which attachment elements enable said support frame to be locally attached to a surface of a previously cast wall portion.

4. A scaffolding assembly as set forth in claim 3, wherein said second cooperable means on said support frame for raising said support and movable frames includes a plurality of rollers mounted on said uprights for rolling on a surface of a previously cast wall portion, and said motor means being cylinders acting in traction, each cylinder being pivoted at a lower end to a member attached to a lower end of one of said uprights and having an upper end engaged with one of said attachment elements.

5. A scaffolding assembly as set forth in claim 3, wherein each of said attachment elements is aligned with one of said uprights of said support frame and is generally corbel-shaped; each attachment element having spaced rear support areas adapted to bear against a previously cast wall portion, a forwardly extending section with a substantially horizontal upper surface acting as a support surface, and a front plate adapted to cooperate with one face of the upright aligned therewith to provide a vertical guide therefor; each attachment element being temporarily attachable to a previously cast wall portion by means of a bar passing through said attachment element and a tapered wedge, there being at least one such attachment element per upright per previously cast wall layer.

6. A scaffolding assembly as set forth in claim 5, wherein said clamping means include at least two cams attached to each upright one above the other and on the face thereof cooperating with said front plates of said attachment elements, said cams progressively engaging said front plates to clamp said upright in position, and said clamping means further including guide boxes attached to said uprights and housing slidable bearing arms, said slidable bearing arms being movable between a forward position in which at least one of said bearing arms positively contacts said support surface of an attachment element and a rear position to which said bearing arms are retracted during raising of the scaffolding unit.

7. A scaffolding assembly as set forth in claim 6, wherein the lengths and profiles of said cams are such that each cam can simultaneously engage two successive attachment elements, the lower of said cams being clamped at its lower end and loose at its upper end, and the attachment element which is positively contacted by one of said slidable bearing arms being the lower one.

8. A scaffolding assembly as set forth in claim 6, wherein each upright of said support frame has an upper bearing arm which is fastened at the beginning of concrete-pouring operations with respect to a lowermost wall layer.

9. A scaffolding assembly as set forth in claim 1, including adjusting means carried by said cantilever member and connected to said movable frame for continuously adjusting the distance between said movable and support frames to ensure a constant distance to the facing surface of said wall in progress.

10. A scaffolding assembly as set forth in claim 2, wherein said uprights of said support frame are fitted with respective adjustable supports for said first shuttering panel to ensure that it bears against said uprights.

11. A scaffolding assembly as set forth in claim 2, wherein said movable frame includes uprights, and said catwalks are pivoted to respective ones of said uprights of said support frame and said movable frame and to uprights parallel thereto which are inter-connected by horizontal rails forming guard rails, so as to form a succession of four arm linkages, and wherein respective cross-pieces attached to said support and movable frames carry respective means for simultaneously maintaining the catwalks horizontal, said cross-pieces limiting the inclination of said catwalks when not supported by the last mentioned means.

12. A scaffolding assembly as set forth in claim 1, wherein at least one side of each catwalk is provided with means for extending the catwalk, so that when said assembly is used with other like assemblies it is possible to provide a catwalk continuous from one assembly to the next.

* * * * *